US005536095A

United States Patent [19]

Diamond

[11] Patent Number: 5,536,095

[45] Date of Patent: Jul. 16, 1996

[54] SQUEEGEE WITH A PUMP SUPPLIED SPONGE

[76] Inventor: Peter M. Diamond, P.O. Box 2907, Arcadia, Fla. 33821

[21] Appl. No.: 350,483

[22] Filed: Dec. 7, 1994

[51] Int. Cl.[6] ..... A47L 1/08

[52] U.S. Cl. ..... 401/146; 401/23; 401/150

[58] Field of Search ..... 401/146, 149, 401/150, 23

[56] References Cited

U.S. PATENT DOCUMENTS

| | | | |
|---|---|---|---|
| 1,464,419 | 8/1923 | Gill | 401/146 X |
| 1,615,104 | 1/1927 | Walker | 401/150 |
| 2,702,915 | 3/1955 | Anderson | 401/146 X |
| 2,722,701 | 11/1955 | Blum et al. | 401/23 X |
| 2,995,768 | 8/1961 | Skuratowicz | 401/146 |
| 3,118,166 | 1/1964 | Bell | 401/150 X |
| 3,455,638 | 7/1969 | Braswell | 401/23 |

FOREIGN PATENT DOCUMENTS

| | | | |
|---|---|---|---|
| 2316276 | 10/1974 | Germany | 401/23 |
| 571834 | 1/1958 | Italy | 401/146 |
| 854652 | 11/1960 | United Kingdom | 401/23 |

*Primary Examiner*—Steven A. Bratlie

[57] ABSTRACT

A squeegee with a pump supplied sponge comprising a handle having a hollow interior, the handle having an inboard region, an outboard region, an upper surface and a lower surface, the interior of the outboard region including a reservoir for the retainment of fluid, the reservoir having a fill spout to permit the receipt of fluid, the inboard region having a fluid pump positioned therein, a trigger formed in a cylindrical configuration being operatively coupled to the pump, the user depressing the trigger to activate the pump; and a cleaning head formed in a rectangular configuration, the cleaning head having a sponge extending from one end and a squeegee extending from the opposite end, an extension shaft with two open ends being coupled to the cleaning head, the first end of the shaft being coupled to the inboard end of the handle, a plurality of hoses formed in a long cylindrical configuration with two open ends, a first end of each hose being operatively coupled to the cleaning head, a second end of each hose being operatively coupled to the pump, the length of the hose being positioned through the extension shaft.

1 Claim, 4 Drawing Sheets

SQUEEGEE WITH A PUMP SUPPLIED SPONGE

BACKGROUND OF THE INVENTION

1. Field of the Invention

The present invention relates to a squeegee with a pump supplied sponge and more particularly pertains to cleaning glass and other surfaces by pumping cleaning fluid to the sponge of the apparatus for application to a recipient surface.

2. Description of the Prior Art

The use of squeegee devices is known in the prior art. More specifically, squeegee devices heretofore devised and utilized for the purpose of cleaning various surfaces are known to consist basically of familiar, expected, and obvious structural configurations, notwithstanding the myriad of designs encompassed by the crowded prior art which has been developed for the fulfillment of countless objectives and requirements.

By way of example, the prior art discloses in Des. U.S. Pat. No. 338,297 to Singarella a combined sponge, squeegee, and fluid dispensing container with cap.

U.S. Pat. No. 5,054,945 to Iggulden discloses a compact window-washing bottle with protected sponge and squeegee.

U.S. Pat. No. 3,783,469 to Siemund discloses a combination window washer, scraper and squeegee.

U.S. Pat. No. 3,837,747 to Seymore discloses a washer/squeegee.

Lastly, Des. U.S. Pat. No. 327,146 to Miller discloses a combined squeegee and sponge for cleaning showers.

In this respect, the squeegee with a pump supplied sponge according to the present invention substantially departs from the conventional concepts and designs of the prior art, and in doing so provides an apparatus primarily developed for the purpose of cleaning glass and other surfaces by pumping cleaning fluid to the sponge of the apparatus for application to a recipient surface.

Therefore, it can be appreciated that there exists a continuing need for a new and improved squeegee with a pump supplied sponge which can be used for cleaning glass and other surfaces by pumping cleaning fluid to the sponge of the apparatus for application to a recipient surface. In this regard, the present invention substantially fulfills this need.

SUMMARY OF THE INVENTION

In view of the foregoing disadvantages inherent in the known types of squeegee devices now present in the prior art, the present invention provides an improved squeegee with a pump supplied sponge. As such, the general purpose of the present invention, which will be described subsequently in greater detail, is to provide a new and improved squeegee with a pump supplied sponge and method which has all the advantages of the prior art and none of the disadvantages.

To attain this, the present invention essentially comprises a new and improved squeegee with a pump supplied sponge comprising, in combination: a handle fabricated of plastic and formed in a cylindrical configuration with two flat ends, the handle having an inboard region, an outboard region, an upper surface and a lower surface, the handle having a generally rectangular shaped projection extending upwardly from its upper surface adjacent to its inboard end, the projection having a generally cylindrical shaped bore extending therein; a pump formed in a generally cylindrical configuration, the pump including radially positioned apertures extending through diametrically opposing sides of its lower extent, the pump being positioned within the hollow interior of the handle below the bore, a cover with a central aperture being positioned upon the uppermost extent of the pump, a planar circular disc shaped plunger being positioned within the pump, a cylindrical shaft being affixed to the plunger, the shaft extending upwardly from the plunger and through the aperture in the cover, the uppermost extent of the shaft including a planar circular shaped trigger affixed thereto, the shaft and trigger being positioned in the bore, a resilient tension spring being formed of looped metal wire being positioned around the shaft below the trigger, the trigger adapted to be depressed by the user thereby forcing the plunger downward and causing movement of fluid into the pump, the resilient spring forcing the trigger back to its original position when released; a small cylindrically shaped collar with coupling means being positioned in the upper surface of the outboard of region of the handle, a fill cap being coupled to the collar, the interior of the outboard region being formed as a cylindrical shaped reservoir adapted to retain cleaning fluid, the reservoir communicating with the pump through a cylindrically shaped valve positioned in a radial aperture of the pump, the valve allowing one way flow of cleaning fluid into the pump when the button or trigger is released by the user, the diametrically opposing side of the pump also having a one way valve adapted to permit the flow of cleaning fluid from the pump to the inboard region of the handle, the furthest extent of the inboard region of the handle including a hollow cylindrical shaped member extending perpendicular therefrom, the member having coupling means at its free end; an extension rod formed in a hollow cylindrical configuration with two open ends, a first end including coupling means and adapted to be releasably coupled to the cylindrical member on the inboard end of the handle; and a cleaning head including a cylindrically shaped plug, the plug being positioned within the extension rod, the plug having three axially positioned apertures, three rigid hoses formed in a hollow cylindrical configuration, a first and second hose formed in an generally L-shaped orientation and positioned in two of the apertures of the plug, a third hose formed in a linear configuration and positioned between the first and second hoses, a holder being fabricated of plastic and formed in a generally rectangular configuration with a hollow interior, the holder having slots in two opposing ends, the hoses being positioned in the hollow interior of the holder, a rubber squeegee being formed in curved planar rectangular configuration and positioned in a rectangular slot, a sponge being fabricated in a rectangular configuration and positioned in a rectangular slot adjacent to the free ends of the hoses, the apparatus permitting the user to pump cleaning fluid into the sponge for application to a recipient surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved squeegee with a pump supplied sponge which has all of the advantages of the prior art squeegee devices and none of the disadvantages.

It is another object of the present invention to provide a new and improved squeegee with a pump supplied sponge which may be easily and efficiently manufactured and marketed.

It is further object of the present invention to provide a new and improved squeegee with a pump supplied sponge which is of durable and reliable constructions.

An even further object of the present invention is to provide a new and improved squeegee with a pump supplied sponge which is susceptible of a low cost of manufacture with regard to both materials and labor, and which accordingly is then susceptible of low prices of sale to the consuming public, thereby making such squeegee with a pump supplied sponge economically available to the buying public.

Still yet another object of the present invention is to provide a new and improved squeegee with a pump supplied sponge which provides in the apparatuses and methods of the prior art some of the advantages thereof, while simultaneously overcoming some of the disadvantages normally associated therewith.

Still another object of the present invention is to clean glass and other surfaces by pumping cleaning fluid to the sponge of the apparatus for application to a recipient surface.

Lastly, it is an object of the present invention to provide a new and improved squeegee with a pump supplied sponge comprising a handle having a hollow interior, the handle having an inboard region, an outboard region, an upper surface and a lower surface, the interior of the outboard region including a reservoir for the retainment of fluid, the reservoir having a fill spout to permit the receipt of fluid, the inboard region having a fluid pump positioned therein, a trigger formed in a cylindrical configuration being operatively coupled to the pump, the user depressing the trigger to activate the pump; and a cleaning head formed in a rectangular configuration, the cleaning head having a sponge extending from one end and a squeegee extending from the opposite end, an extension shaft with two open ends being coupled to the cleaning head, the first end of the shaft being coupled to the inboard end of the handle, a plurality of hoses formed in a long cylindrical configuration with two open ends, a first end of each hose being operatively coupled to the cleaning head, a second end of each hose being operatively coupled to the pump, the length of the hose being positioned through the extension shaft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
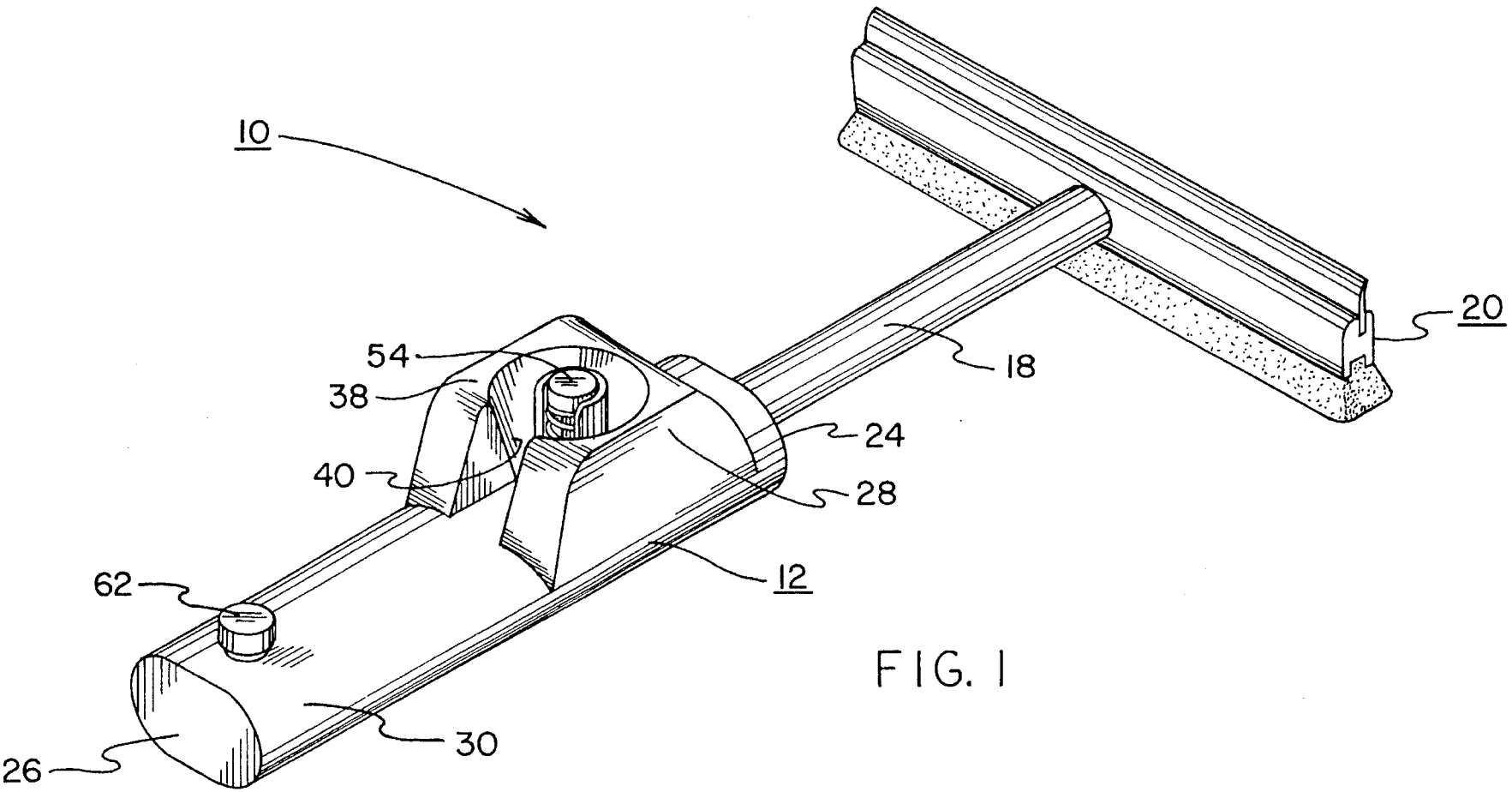
FIG. 1 is a perspective view of the preferred embodiment of the squeegee with a pump supplied sponge constructed in accordance with the principles of the present invention.

With reference now to the drawings, and in particular to FIG. 1 thereof, the preferred embodiment of the new and improved squeegee with a pump supplied sponge embodying the principles and concepts of the present invention and generally designated by the reference numeral 10 will be described.

The present invention, the squeegee with a pump supplied sponge 10, is comprised of a plurality of components. Such components in their broadest context include a handle 12, a pump 14, an extension rod 18 and a cleaning head 20. Such components are individually configured and correlated with respect to each other so as to attain the desired objective.

Figure 2:
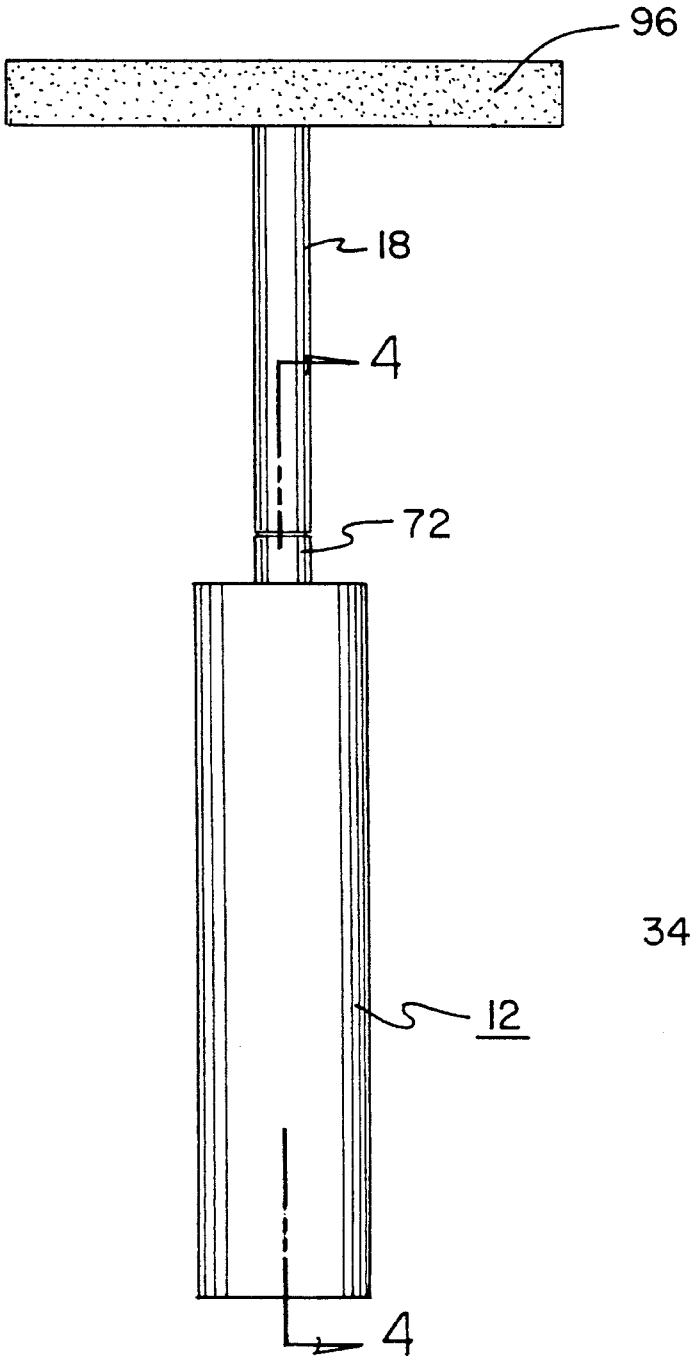
FIG. 2 is a perspective view of the lower surface of the apparatus shown in FIG. 1.
Figure 3:
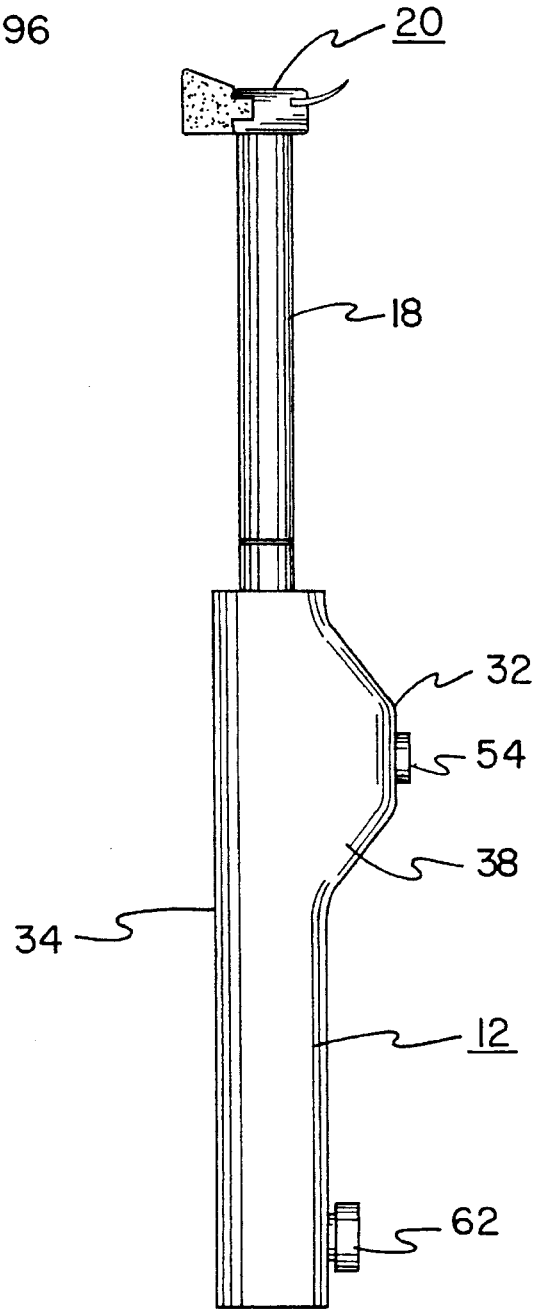
FIG. 3 is a side perspective view of the apparatus shown in FIG. 1.

More specifically, the handle 12 is fabricated of sturdy lightweight plastic. It is formed in a cylindrical configuration with a flat inboard end 24 and a flat outboard end 26. The handle has an inboard region 28, an outboard region 30, an upper surface 32 and a lower surface 34. The cylindrical configuration of the handle provides a comfortable gripping surface for the user. Note FIGS. 2 and 3.

Figure 6:
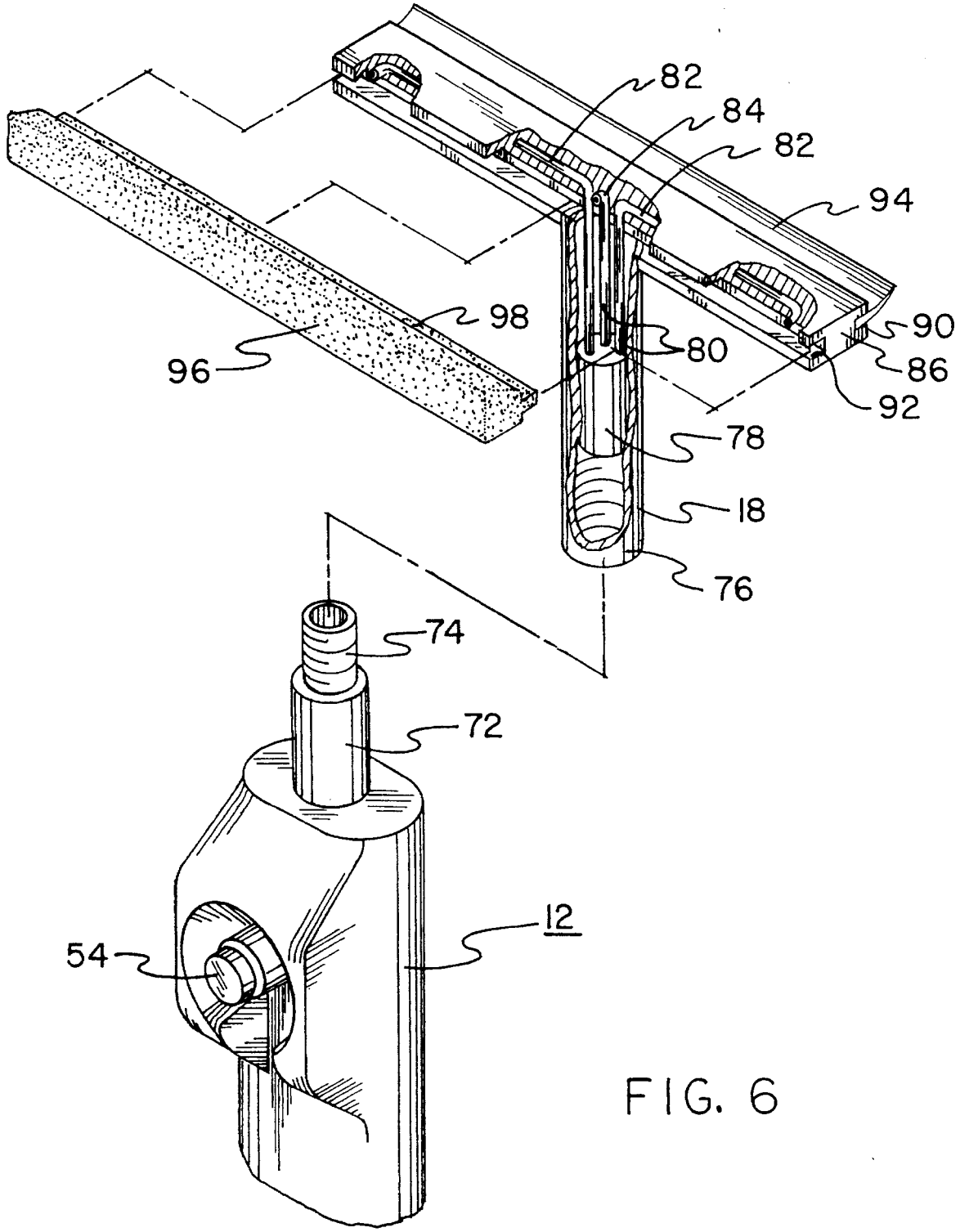
FIG. 6 is a partially broken away perspective view of the cleaning head, extension shaft and handle of the apparatus.

The handle has a generally rectangular shaped projection 38 which extends upwardly from its upper surface adjacent to the inboard end. The projection has a generally semicircular shaped bore 40 extending therein. The bore enables the user to comfortably position his thumb within its interior. The contoured design of the bore and projection enables the user to comfortably activate the trigger when pumping is required. Note FIGS. 1 and 6.

Figure 4:
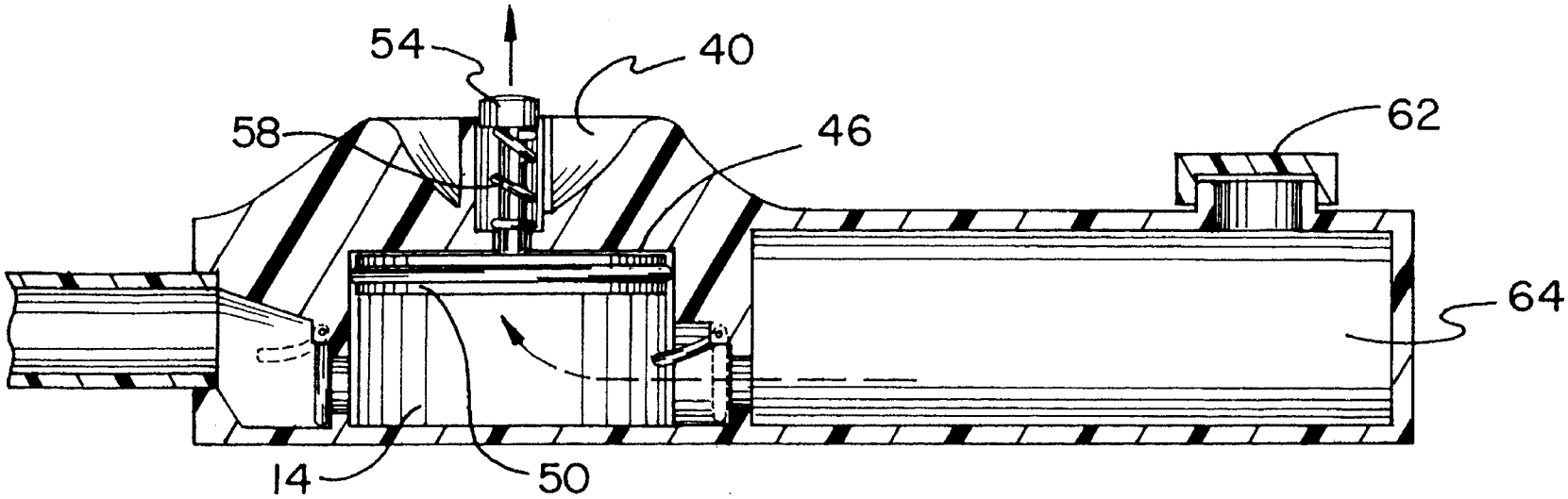
FIG. 4 is a cross-sectional view of the apparatus taken along line 4—4 of FIG. 2 and illustrating the pump in the released orientation.
Figure 5:
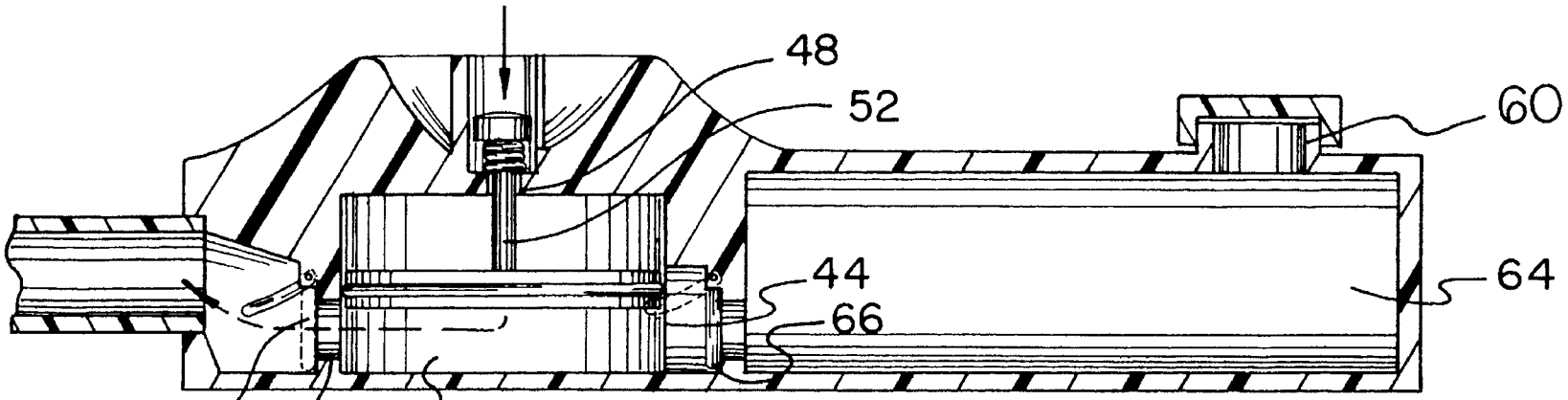
FIG. 5 is a cross-sectional view of the apparatus taken along line 4—4 of FIG. 2 and illustrating the pump in the depressed orientation.

A pump 14 is positioned within the hollow interior of the handle below the bore. The pump is shaped in a generally cylindrical configuration with apertures 42, 44 extending through its lower extent at diametrically opposing sides. The apertures in the pump include one-way valves positioned therein. The one-way valves only permit the flow of fluid in an inboard direction. Note FIGS. 4 and 5.

The uppermost extent of the pump has a cover 46 positioned on it. The cover has an aperture 48 extending through its center point. A planar circular disc shaped plunger 50 is positioned within the cylindrical pump. A shaft 52 is affixed to the plunger and extends upwardly and through the aperture in the cover of the pump. The uppermost extent of the shaft includes a planar circular shaped trigger 54. The shaft and trigger are positioned in the cylindrically shaped bore. A resilient tension spring 58 being formed of looped metal wire positioned around the shaft below the trigger. The trigger is adapted to be depressed by the user. The resilient spring forces the trigger back to its original position when released. Note FIGS. 4, 5 and 6.

The user activates the pump by depressing the trigger thereby forcing the plunger downward. This action causes movement of fluid from the pump to the extension shaft of the apparatus. This action also forces the valve between the reservoir and the pump to be forced shut. When the user releases the trigger, the suction causes the movement of fluid from the reservoir into the pump. This action also causes the valve between the pump and extension rod to be forced shut. Note FIGS. 4 and 5.

The upper surface of the outboard of portion of the handle includes a small cylindrically shaped collar 60 with a plurality of external screw threads. A fill cap 62 is coupled to the collar. The hollow interior of the outboard region of the handle is formed as a generally cylindrical shaped reservoir 64. The reservoir is adapted to retain cleaning fluid in the operative orientation. The fill cap is easily removed when refilling of the reservoir is required. In an alternative embodiment of the apparatus the handle is fabricated of clear plastic so the user can easily determine the cleaning fluid level at any point in time. Note FIGS. 1, 4 and 5.

The reservoir communicates with the pump by means of a cylindrical one-way shaped valve 66. The valve is positioned in an aperture of the pump. The valve allows one way flow of cleaning fluid into the pump when the trigger is released by the user. The diametrically opposing side of the pump has a second one-way valve 68 adapted to permit the flow of cleaning fluid from the pump to the inboard region of the handle. The configuration of the pump permits the user to easily perform the alternating compression and suction strokes. Note FIGS. 1 and 6.

The inboard end of the handle has a hollow cylindrical shaped member 72 extending perpendicular therefrom. The member has coupling means 74 at its free end. An extension rod 18 is formed in a hollow cylindrical configuration with two open ends. A first end 76 includes a coupling means and adapted to be coupled to the cylindrical member on the inboard end of the handle. The sturdy construction of the extension rod permits the user to apply significant force to the apparatus when cleaning a subject surface. Note FIGS. 1–3.

A cleaning head 20 includes a cylindrically shaped plug 78 which is adapted to be positioned securely within the extension rod. Note FIG. 6. The plug has three axially positioned apertures 80 extending therethrough. The plug creates a virtually airtight seal within the extension rod. Three rigid hoses 82, 84 are formed in a hollow cylindrical configuration. A first and second hose 82 are formed in an generally L-shaped orientation and positioned in two of the apertures in the plug. A third hose is formed in a linear configuration and positioned between the first and second hoses. When the user activates the pump cleaning fluid is forced through the cylindrical member and extension rod. The fluid is then forced through the apertures in the plug and into the hoses. Note FIGS. 4 and 6.

A holder 86 is fabricated of plastic and formed in a generally rectangular configuration with a hollow interior. The holder 86 has slots 90, 92 in two opposing ends. The hoses are positioned in the hollow interior of the holder. A rubber squeegee 94 is formed in curved planar rectangular configuration. The squeegee is positioned in a rectangular slot of the apparatus. The squeegee is fabricated of sturdy weather-resistant rubber to enhance its strength and durability. The squeegee enables the user to remove dirt and fluid from the subject after the sponge has been applied. The squeegee is particularly effective when used on glass surfaces. Note FIGS. 1, 3 and 6.

A sponge 96 is formed in a rectangular configuration and includes a small projection 98 which extends from one of its ends. The projection of the sponge is positioned in the second slot adjacent to the free ends of the hoses. The hoses have a slight curve at their free ends to direct fluid flow into the sponge. When the pump is activated by the user the fluid ultimately is directed into the sponge. When the sponge is treated with the fluid the user applies the sponge to the subject surface. The abrasive properties of the sponge, coupled with the chemical properties of the cleaning fluid, permit the user to easily clean a wide variety of subject surfaces, particularly glass. The squeegee is used to remove any remaining excess fluid. Note FIGS. 1 and 6.

The squeegee with a pump supplied sponge is a hand tool with a rubber blade, commonly called a squeegee. It is used like a windshield wiper to clean a variety of surfaces, particularly glass, after cleaning fluid has been applied with the sponge of the apparatus.

While hand squeegees are readily available, this unit is distinguished from the others because it has its own supply of cleaning liquid. The cleaning fluid is retained within the handle mounted reservoir of the apparatus. The handle is made of plastic which can be clear to check the fluid level. A trigger protrudes from the apparatus to pump the liquid into the sponge on the cleaning head of the apparatus. The pump is a spring loaded cylinder with valves which draw the fluid in when the compression spring pushes the shaft upward. A trigger on the handle forces the cleaning liquid through a plurality of rigid tubes and into the sponge. The squeegee can be made in various sizes, one of which may be eight inches wide, with a twenty two inch long handle.

After the sponge is filled by virtue of the pumping action, the glass is wiped with the sponge to remove dirt. The squeegee is then used to scrape the liquid from the glass in the usual manner and with the usual efficiency.

Different size reservoirs are available. One size holds eighteen ounces of fluid. A larger size has a capacity of twenty six ounces. This device could also be made in the form of a pistol.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved squeegee with a pump supplied sponge comprising, in combination:

a handle having a hollow interior, the handle being fabricated of plastic and formed in a cylindrical configuration with two flat ends, the handle having an inboard region, an outboard region, an upper surface and a lower surface, the interior of the outboard region including a reservoir adapted to contain between eighteen and thirty ounces of fluid, the reservoir having a fill spout to permit the receipt of fluid therethrough, the handle having a generally rectangular shaped projection extending upwardly from its upper surface adjacent to its inboard end, the projection having a generally cylindrical shaped bore extending therein;

a pump formed in a generally cylindrical configuration, the pump including radially positioned apertures extending through diametrically opposing sides of its lower extent, the pump being positioned within the hollow interior of the handle below the bore, a cover with a central aperture being positioned upon with upper most extent of the pump, a planar circular disc shaped plunger being positioned within the pump, a cylindrical shaft being affixed to the plunger, the shaft extending upwardly from the plunger and through the aperture in the cover, the upper most extent of the shaft including a planar circular shaped trigger affixed thereto, the shaft and trigger being positioned in the bore, a resilient tension spring being formed of looped metal wire being positioned around the shaft below the trigger, the trigger adapted to be depressed by the user thereby forcing the plunger downward and causing movement of fluid into the pump, the resilient spring forcing the trigger back to its original position when released;

a small cylindrically shaped collar with coupling means being positioned in the upper surface of the outboard region of the handle, a fill cap being coupled to the collar, the interior of the outboard region being formed as a cylindrical shaped reservoir adapted to retain cleaning fluid, the reservoir communicating with the pump through a cylindrically shaped valve positioned in a radial aperture of the pump, the valve allowing one way flow of cleaning fluid into the pump when the trigger is released by the user, the diametrically opposing side of the pump also having a one way valve adapted to permit the flow of cleaning fluid from the pump to the inboard region of the handle, the furthest extent of the inboard region of the handle including a hollow cylindrical shaped member extending perpendicular therefrom, the member having coupling means at its free end;

an extension rod formed in a hollow cylindrical configuration with two open ends, a first end including coupling means and adapted to be releasablely coupled to the cylindrical member on the inboard end of the handle; and a cleaning head including a cylindrically shaped plug, the plug being positioned within the extension rod, the plug having three axially positioned apertures, three rigid hoses formed in a hollow cylindrical configuration, a first and second hose formed in a generally L-shaped orientation and positioned in two of the apertures of the plug, a third hose formed in a linear configuration and positioned between the first and second hoses, a holder being fabricated of plastic and formed in a generally rectangular configuration with a hollow interior, the holder having slots in two opposing ends, a first end of each hose being operatively positioned in the hollow interior of the holder, a second end of each hose being operatively coupled to the plug, a rubber squeegee being formed in curved planar rectangular configuration and positioned in a rectangular slot, a sponge being fabricated in a rectangular configuration and positioned in a rectangular slot adjacent to a first end of each hose, the apparatus permitting the user to pump cleaning fluid into the sponge for application to a recipient surface.

* * * * *